United States Patent [19]

Mickelson

[11] 4,011,699

[45] Mar. 15, 1977

[54] TELESCOPIC BOOM QUICK RETRACT HYDRAULIC CIRCUIT

[75] Inventor: Roger D. Mickelson, Cedar Rapids, Iowa

[73] Assignee: FMC Corporation, San Jose, Calif.

[22] Filed: Aug. 27, 1975

[21] Appl. No.: 608,111

[52] U.S. Cl. ..... 52/115; 212/55

[51] Int. Cl.[2] ..... E04H 12/34; F15B 7/00

[58] Field of Search ..... 52/115; 212/46 B, 55

[56] References Cited

UNITED STATES PATENTS

| | | | |
|---|---|---|---|
| 2,938,351 | 5/1960 | Brooks | 214/51 |
| 3,481,489 | 12/1969 | Stauffer | 212/55 |
| 3,609,974 | 10/1971 | Lado | 212/55 X |
| 3,610,433 | 10/1971 | Milner, Jr. | 212/55 X |
| 3,620,579 | 11/1971 | Brown | 212/55 X |
| 3,841,494 | 10/1974 | Chalupsky | 212/55 |

*Primary Examiner*—Alfred C. Perham
*Attorney, Agent, or Firm*—J. F. Verhoeven; C. E. Tripp

[57] ABSTRACT

There is disclosed a telescoping boom with first and second motors, each connected between adjacent boom sections to extend and retract one boom section with respect to the other. Each motor has a piston slidably received in a cylinder to define an extend chamber on one side of the piston and a retract chamber on the other side thereof. Each piston has a rod extending from the cylinder which has two passages therein, one communicating with the extend chamber and the other communicating with the retract chamber. A control valve has a first portion for control of the first motor and a second portion for control of the second motor. The hydraulic passage between the retract chamber of the second motor and the second valve portion includes the retract chamber of the first motor. The hydraulic passage between the extend chamber of the second motor and the second valve portion, and only that passage, passes over a reel between said members.

7 Claims, 10 Drawing Figures

TELESCOPIC BOOM QUICK RETRACT HYDRAULIC CIRCUIT

BACKGROUND OF THE INVENTION

1. Field of the Invention

The present invention relates to a hydraulic system for extending and retracting a telescopic boom, such as provided in a crane, and, more particularly, to such a system adapted to retract the boom quickly.

2. Description of the Prior Art

In a typical hydraulic system to extend and retract a telescopic boom, two hydraulic motors are provided: a first motor connected between the base boom section and the mid boom section (which motor may be identified as the mid boom telescoping motor) and a second motor connected between the mid boom section and the tip boom section (which motor may be identified as the tip boom motor). Each motor usually consists of a cylinder with a piston slidably received therein to define two chambers in the cylinder: an extend chamber in which fluid under pressure is received to extend one boom section to which the motor is connected with respect to the other connected boom section, and a retract chamber in which fluid under pressure is received to retract said one boom section with respect to said other boom section. Each piston has a piston rod connected thereto which extends from the cylinder. It has been known heretofore to provide two passages through each piston rod, one to the extend chamber of the cylinder in which the piston is contained and the other to the retract chamber of that cylinder. A control valve is generally provided which has a first valve portion to control the first hydraulic motor and a second valve portion to control the second hydraulic motor.

In the usual installation, the piston rod of the first, or mid boom, motor is secured to the base boom section (which pivots but does not move axially). Consequently, the piston rod of the first motor does not move axially, and the two passages extending therethrough can be conveniently connected to the first valve portion to control the flow of pressure fluid to, and the flow of return fluid from, the extend and retract chambers of the first motor. The cylinder end of the first hydraulic motor is connected to the mid boom section for extension thereof when the first motor is extended.

The rod end of the second, or tip boom, motor is generally connected to the mid boom section (for movement therewith when the mid boom section is extended by extension of the first motor), and the cylinder end of the second motor is connected to the tip boom section for extension thereof relative to the mid boom section when the second hydraulic motor is extended.

Since the rod end of the second motor moves axially (although not to the extent of the cylinder end), the passages through the piston rod must be connected to the second valve portion (for the supply of fluid to and the return of fluid from the extend and retract chambers of the motor) by means of flexible hoses. It is also customary to provide a reel mounted between the second motor and the second valve portion to store a portion of the flexible hose when the mid boom section is retracted, and to pay out said portion of flexible hose when the mid boom section is extended.

A significant problem encountered with the prior art hydraulic telescoping system for a boom lies in the excessive time it takes to retract the boom, and particularly the tip boom section thereof. It is the solution of this problem to which the present invention is directed.

SUMMARY OF THE INVENTION

I have realized that in order to retract the tip boom section, it is necessary to both introduce fluid into the retract chamber of the tip boom motor and to simultaneously empty fluid from the extend chamber of that motor.

I have also recognized that both the introduction of fluid into the retract chamber of the tip boom motor and the exhaust of fluid from the extend chamber of that motor (for retraction of the motor) is restricted by the winding of the flexible extend and retract lines on the reel.

And finally, I have recognized that the exhaustion of the extend chamber of the tip boom motor is a substantially more critical problem than the introduction of fluid to the retract chamber. This is because the cross-sectional area of the extend chamber (which has no piston rod extending therethrough) is much larger (on, for example, the order of 3 to 1) than the effective cross-sectional area of the retract chamber because of the large piston rod extending therethrough.

By two small, but important, circuit changes, I have substantially increased the rate at which I can exhaust fluid from the extend chamber of the tip boom motor, thereby substantially increasing the rate at which I can retract the tip boom section.

In brief, I have taken advantage of the fact that both the rod end of the tip boom motor and the cylinder end of the mid boom motor are connected to the mid boom section so that they always move in unison and never move relative to each other. Therefore, I have connected the retract passage of the tip boom motor piston rod to the mid boom motor cylinder for direct communication between the two retract chambers of the respective motors. This modification eliminates the need of having the retract line of the tip boom motor mounted on the reel with the extend line of that motor so that only the extend line need by carried by the reel. However, instead of removing from the reel the flexible hose which formerly served as the retract line for the tip boom motor, I have connected it in parallel to the extend line to form a double extend line on the reel. The result of this second modification, by which the extend line capacity at the reel is doubled, is to drastically reduce the restrictive effect the reel had on the single extend line mounted thereon. Accordingly, the extend chamber with its substantially greater volume than the retract chamber can be exhausted substantially faster with my double extend line on the reel than was formerly possible with the single extend line thereon. Alternatively, I can use a significantly larger single extend line only on the reel (and, if possible, increase the diameter of the reel) to reduce the restrictive effect of the reel on the extend line. Since exhaustion of the extend cylinder was the critical factor is retracting the speed of retraction of the tip boom section, I have succeeded in substantially increasing the rate of retraction of this member.

It is therefore one object of the present invention to increase the rate of retraction of a telescopic boom.

It is another object of the present invention to increase the speed of retraction of the tip boom section.

It is still another object of the present invention to increase the rate of flow from the extend chamber of the tip boom motor.

DESCRIPTION OF THE PREFERRED EMBODIMENT

Figure 1:
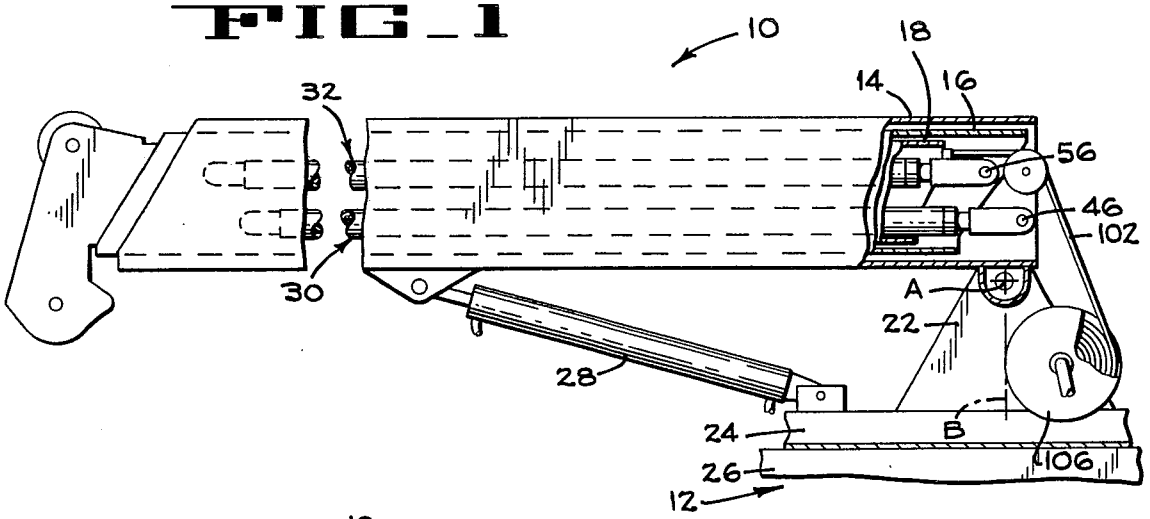
FIG. 1 is a side view of a telescopic boom, in the retracted condition, which may, for example, be the boom of a crane.
Figure 2:
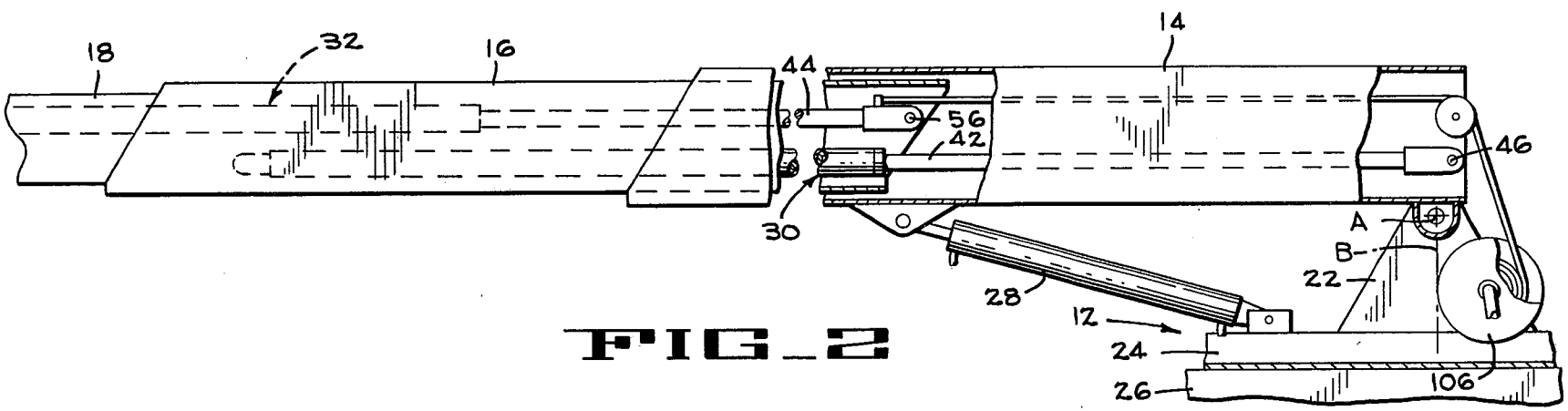
FIG. 2 is a side view of the telescopic boom of FIG. 1 in a partially extended condition.
Figure 3:
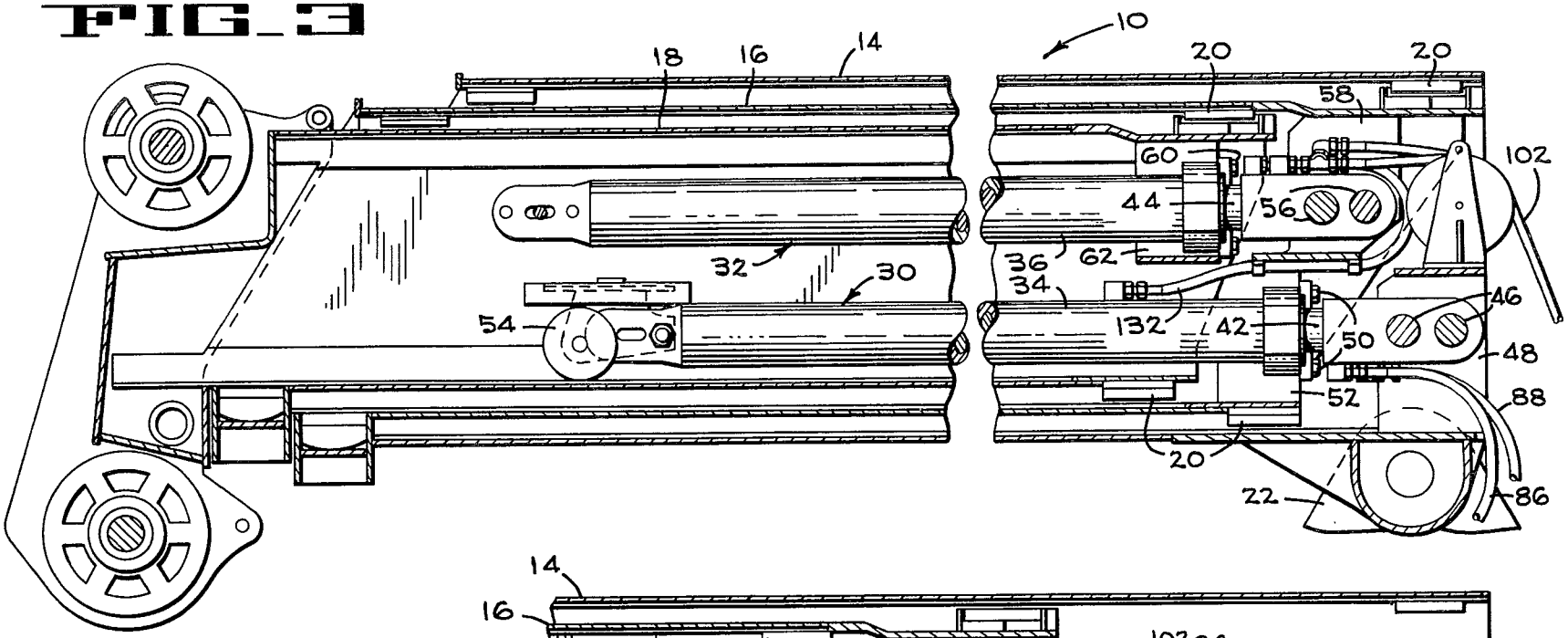
FIG. 3 is an enlarged fragmentary cross-sectional view taken as the view of FIG. 1.
Figure 4:
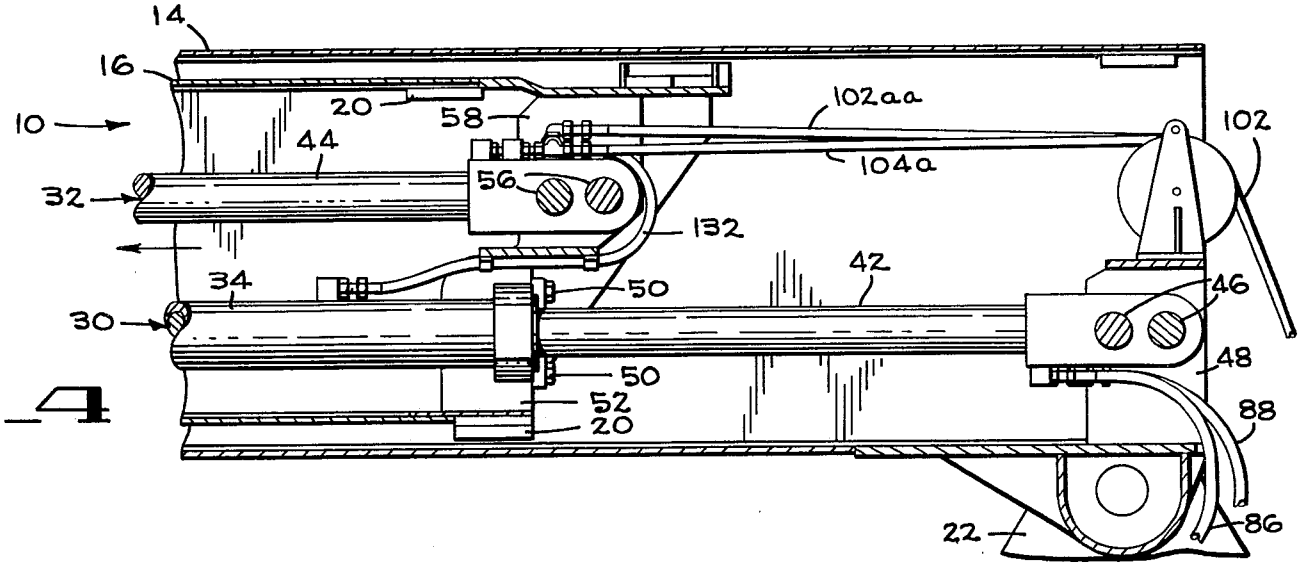
FIG. 4 is an enlarged fragmentary cross-sectional view taken as the view of FIG. 2.
Figure 5:
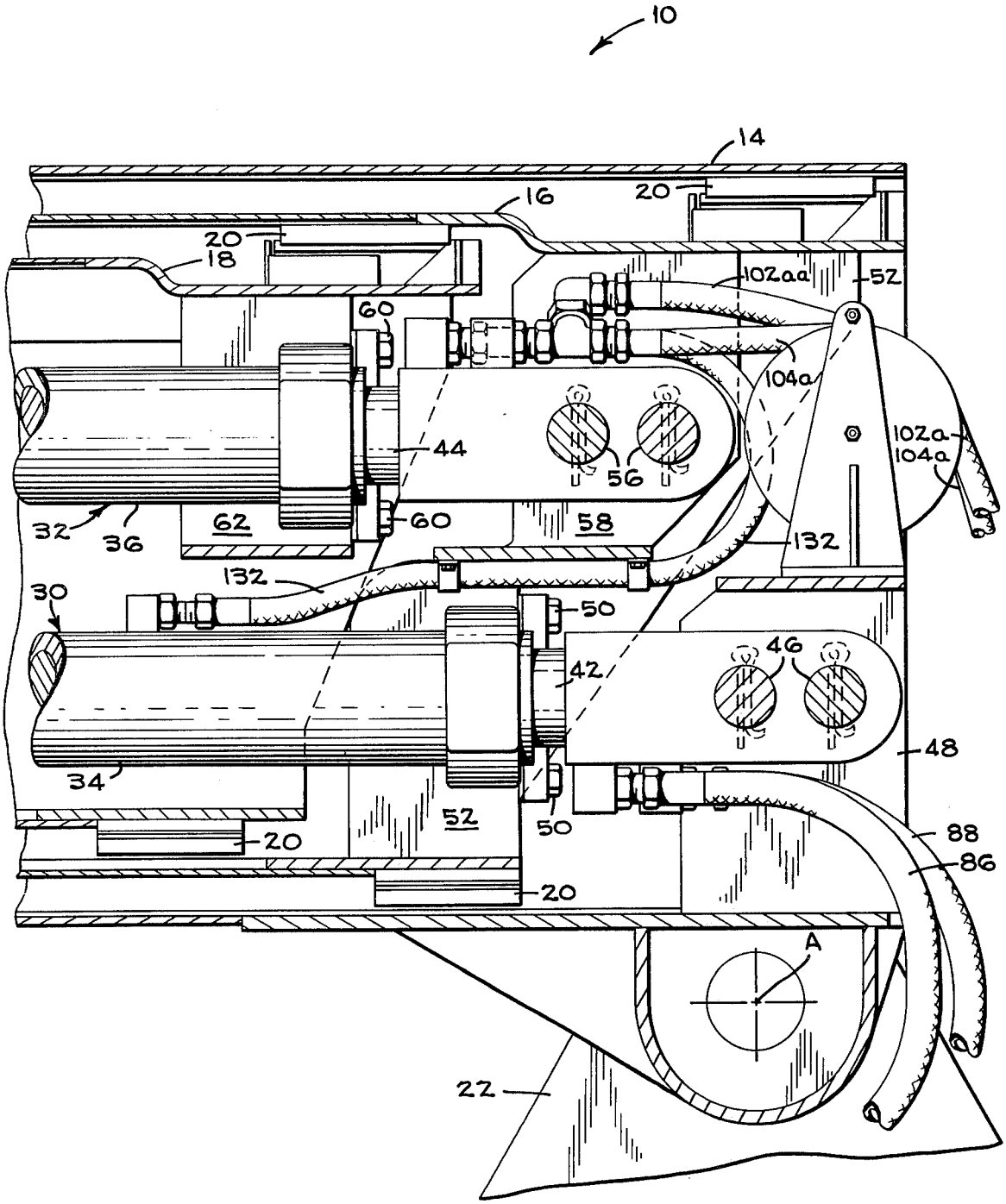
FIG. 5 is an enlarged fragmentary view taken as the view of FIG. 3.

There is shown in FIGS. 1, 3 and 5, the telescopic boom 10 of a crane 12 with the boom in the fully retracted condition. FIGS. 2 and 4 show the boom 10 in a partially extended condition. The crane has a base boom section 14, a mid boom section 16 slidably received in the base boom section 14, and a tip boom section 18 slidably received in the mid boom section 16. Supporting members, as indicated at 20 (FIG. 5), are mounted between the boom sections for the relative sliding movement of one boom section with respect to an adjacent boom section, as conventionally provided between telescoping boom sections. One end of the base boom section is connected in a mounting frame 22 for pivotal movement about a horizontal axis A, as shown in FIGS. 1 and 2. The mounting frame 22 is secured to a platform 24 which is rotatably mounted on a truck type carrier 26 for rotation about a vertical axis B. An extensible strut 28 is connected between the rotatable platform 24 and the base boom section 14, and pivotally attached to the section 14 at a point spaced from axis A, for the selective elevation of the boom about axis A. A conventional turntable motor (not shown) is provided to rotate platform 24 about axis B.

The base boom section 14, although pivotal about axis A and rotatable about axis B, does not move axially with respect to the truck carrier 26 since it is connected at one end to frame 22. The mid boom section 16 is extended and retracted with respect to base boom section 14 by means of a first hydraulic motor 30, which may be considered to be a mid boom motor. The tip boom section 18 is extended and retracted with respect to mid boom section 16 by means of a second hydraulic motor 32, which may be considered to be a tip boom motor.

Figure 6:
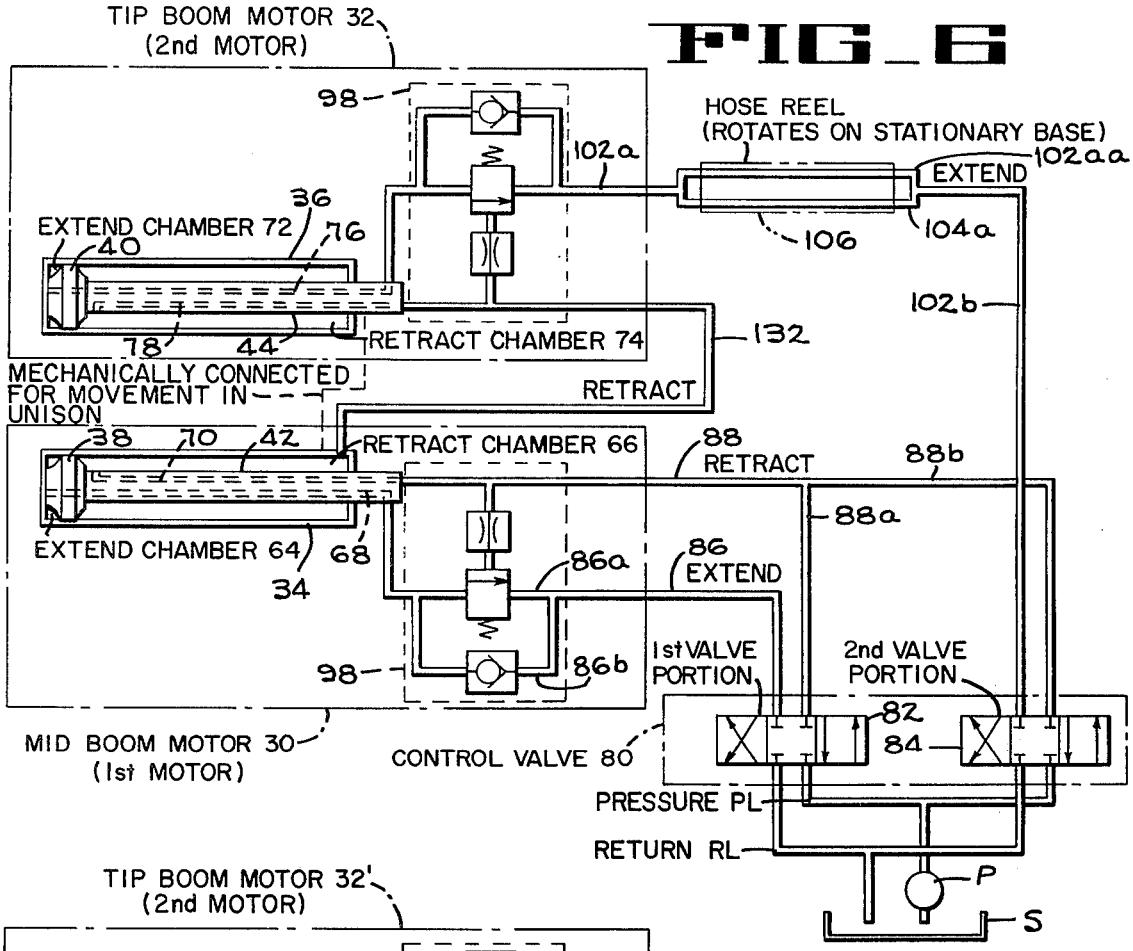
FIG. 6 is a schematic hydraulic diagram showing circuitry according to the present invention as incorporated in the apparatus of FIG. 1.

Each motor 30, 32 has a cylinder 34, 36, respectively, and a piston 38, 40, slidably received therein (see FIG. 6). Each piston has a rod 42, 44 secured thereto and extending from the cylinder. The end of the rod 42 of motor 30 is pinned, as at 46, to vertically extending sides of a bracket 48 secured to the base boom section 14 of the boom. The inner end of cylinder 34 of motor 30 is secured, by bolts 50, to a bracket 52 which is secured to the inner end of mid boom section 16. The outer end of cylinder 34 has a roller 54 mounted thereon to support the outer end of cylinder 34 in the tip boom section. The end of the rod 44 of motor 32 is pinned, as at 56 to vertically extending sides of a bracket 58 secured to the mid boom section 16. The inner end of cylinder 36 of motor 32 is secured, by bolts 60, to a bracket 62 which is secured to the inner end of tip boom section 18.

It will be seen that with the described arrangement of three boom sections and the two motors, which arrangement is known in the prior art, the extension of motor 30 will extend the mid boom section 16 with respect to the base boom section 14, and the extension of motor 32 will extend the tip boom section with respect to the mid boom section. Conversely, the retraction of motor 30 will retract the mid boom section with respect to the base boom section and the retraction of motor 32 will retract the tip boom section with respect to the mid boom section. It will also be noted that the cylinder of the motor 30, and the rod of the motor 32, are both connected to the mid boom section for movement, with the mid boom section, in unison.

Figure 7:
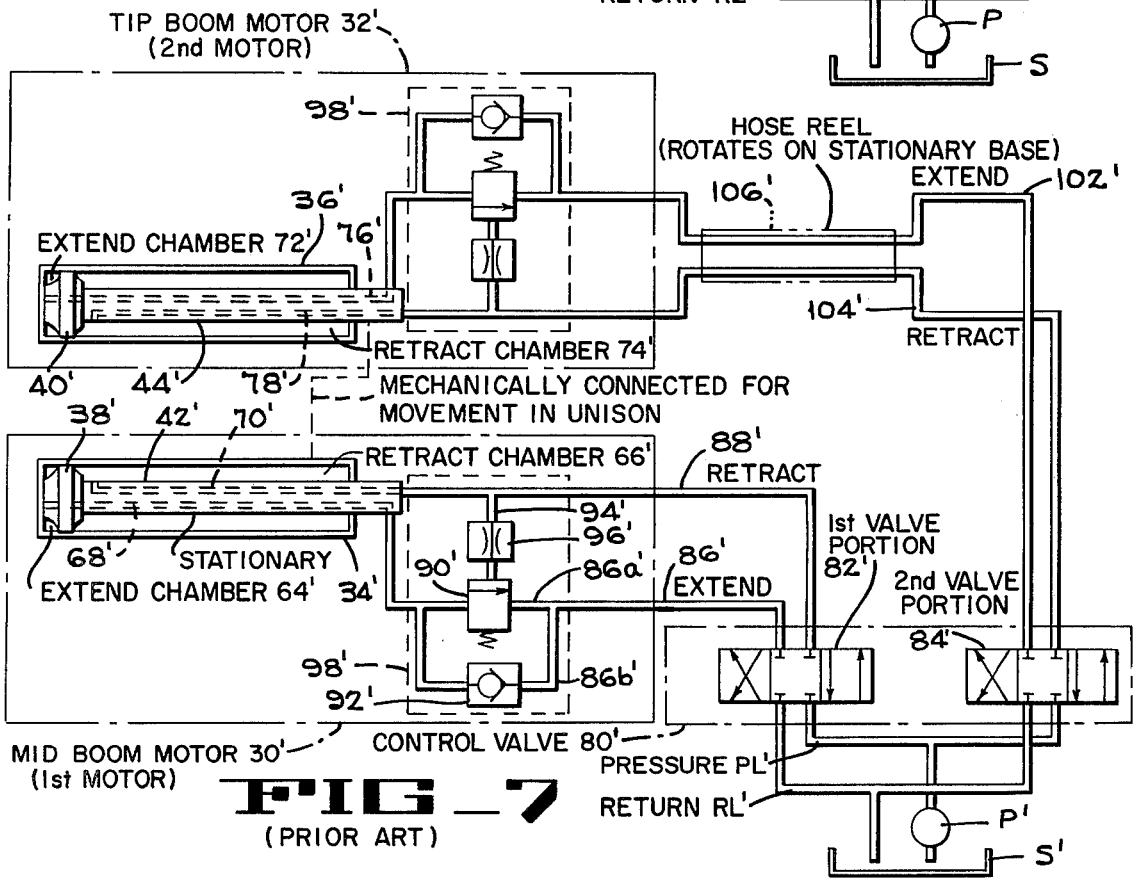
FIG 7 (PRIOR ART)
FIG. 7 is a schematic hydraulic diagram showing prior art circuitry.

It is believed that a better understanding of the present invention will be obtained if a typical prior art hydraulic circuit for operation of the two hydraulic motors, as shown in FIG. 7, is first understood. In FIG. 7, reference numerals similar to reference numerals used in other Figures will be used for corresponding elements, but the numerals in FIG. 7 will be primed, even though the elements may be identical to the corresponding elements of other Figures.

There is shown in FIG. 7 two hydraulic motors 30′ and 32′, similar to motors 30 and 32, for extension and retraction of telescoping boom sections of a boom. Motor 30′ has a cylinder 34′, a piston 38′, and a piston rod 42′ connected to the piston and extending from the cylinder. The piston 38′ serves to divide the interior of the cylinder 34′ into two chambers 64′ and 66′, the former of which may be identified as an extend chamber (that is, the receipt of fluid under pressure therein will cause the motor to extend) and the latter of which may be identified as a retract chamber (that is, the receipt of fluid under pressure therein will cause the motor 30′ to retract). It will be noted that the effective cross sectional piston area (that is, the area of the piston which is acted on by fluid under pressure) is considerably smaller in the retract chamber than in the extend chamber (usually at a ratio of about 1 to 3) because of the space occupied by the piston rod. For the same reason, the maximum volume of the retract chamber (that is, when the motor is fully retracted) is much less (about ⅓) than the maximum volume of the extend chamber (that is, when the motor is fully extended).

The piston rod 42′ has two passages extending therethrough: an extend passage 68′ communicating with the extend chamber 64′, and a retract passage 70′ communicating with the retract chamber 66′.

The motor 32′ has a cylinder 36′, a piston 40′ slidably received therein, and a piston rod 44′ connected to the piston and extending from the cylinder. The motor 32′ has an extend chamber 72′ and a retract chamber 74′ which are similar to the previously described chambers 64′ and 66′ of motor 30′.

The piston rod 44′ has two passages extending therethrough: an extend passage 76′ communicating with the extend chamber 72′, and a retract passage 78′ communicating with the retract chamber 74′.

The circuit of FIG. 7 has a control valve 80′ with a first valve portion 82′ and a second valve portion 84′. Each control valve portion has a pressure port connected to a pressure line PL′ which, in turn is connected to a pump P′ to receive fluid under pressure therefrom. Each control valve portion also has a return port connected to a return line RL′ which leads to sump S′. An extend motor line 86′ extends from a first motor port in the first valve portion 82′ to the extend line 68′ formed in rod 42′ and leading to extend chamber 64′ of the first motor 30′. A retract motor line 88′ extends from a second motor port in the first valve portion to the retract line 70′ formed in rod 42′ and leading to retract chamber 66′ of motor 30′. A holding circuit 98′ is connected between extend and retract lines 86′, 88′ and the rod passages 68′, 70′. The circuit 98′, which is a conventional circuit frequently associated with boom hydraulic motors, has parallel branches 86*a*′ and 86*b*′. Branch 86*a*′ contains a spring biased plot operated blocking valve 90′ and branch 86*b*′ contains a check valve 92′. A pilot line 94′ which is connected at one end to retract line 88′ and which has a restriction 96′ therein, supplies pilot pressure to valve 90′ to operate the valve and permit flow therethrough. The units 90′, 92′, 94′ and 96′, assembled as shown in FIG. 7, constitute the holding circuit 98′ which serves to block the extend line 86′ from passing fluid from the extend chamber (thus preventing the motor 30′ and the mid boom section from retracting) until pressure is introduced into line 88′, by operation of valve portion 82′, to retract the motor.

The cylinder end of motor 30′ is connected to the mid boom section and the rod end of the motor is connected to the base boom section (in the same manner as the motor 30). The rod end of the motor 30′, as the rod end of motor 30, does not move axially on extension or retraction of the boom, and the distance between the rod end of the motor 30′ and the first valve portion 82′ does not vary significantly. However, the lines 86′ and 88′ between the motor 30′ and the control valve 80′ are usually made of flexible hosing to accommodate the pivoting of the base boom section.

An extend motor line 102′ extends from a first motor port of the second valve portion 84′ to the holding circuit 98′ of the tip boom motor 32′ which is identical to the holding circuit of motor 30′. A retract motor line 104′ extends from a second motor port of the second valve portion 84′ to the circuit 98′ of motor 32′.

Figure 9:
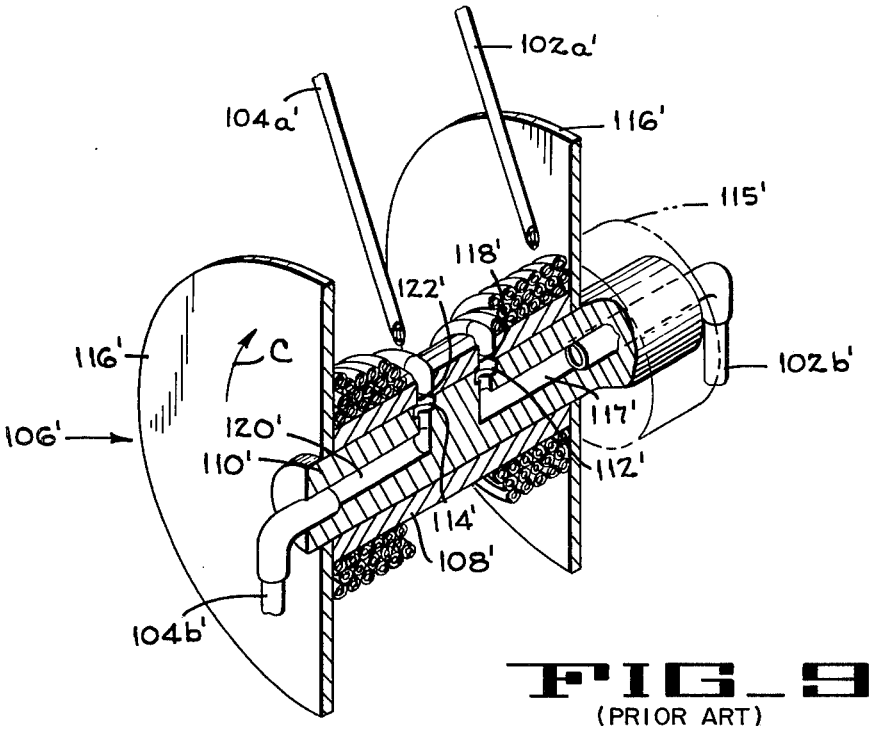
FIG 9 (PRIOR ART)
FIG. 9 is a view in perspective of a prior art reel with connections thereto as made prior to the present invention.

The conventional tip boom motor 32′ (as described in conjunction with tip boom motor 32) has the rod end connected to the mid boom section and the cylinder end connected to the tip boom section. Consequently, when the mid boom section is extended (to travel axially with respect to the base boom section) by extension of the mid boom motor, the tip boom motor, including the rod end thereof, will travel axially with respect to the base boom section. Thus, the lines 102′ and 104′ which connect to the rod passages are made of flexible hose. However, since the valve 80′ is mounted in a fixed position in platform 24, and since the rod end of motor 32′ shifts axially when the motor 32′ is extended, it is common to mount a reel, such as reel 106′ (FIG. 9) on the frame 22 (or other location fixed with respect to the pivot axis A of the boom). The reel 106′ is identical to the reel 106 shown in FIGS. 1, 2 and 8.

The reel 106′ has a hub 108′ which is mounted for rotation on an axle 110′. The axle, which does not rotate, has two grooves 112′ and 114′ therein. The reel has spaced apart flanges 116′ connected to the hub to receive flexible hose from the rod end of the motor therebetween. For purposes of clarity, the extend line 102′ between the motor and the reel will be designated 102*a*′ and the extend line 102′ between the reel and the valve will be designated 102*b*′. Similarly, the retract line 104′ between the motor and the reel will be designated 104*a*′, and the retract line between the reel and the valve will be designated 104*b*′. It will be understood that each of these lines define an unbroken flow passage through the reel at all times. Flexible hose of line 102*b*′ from the second valve portion is received in one end of axle 110′, and secured to the axle in communication with an axial passage 117′ therein. Axial passage 117′ communicates inside the axle with the groove 112′. The end of the flexible hose of line 102*a*′ extending from the motor is wound around the hub of the wheel and is connected into a passage 118′ in the hub which communicates with the groove 112′ so that, at all times, the flexible hose 102*a*′ on the rotating reel is in fluid transmitting communication with the flexible hose 102*b*′ secured to the axle. The retract hose 104*b*′ from the valve is connected into the axle 110′ at the end thereof opposite the end into which line 102*b*′ is connected. The line 104*b*′ communicates in the axle with passage 120′ which, in turn, communicates with groove 114′. Retract line 104*a* from the motor connects into the hub 108′ for communication through passage 122′ in the hub with groove 114′. The axle 110′ extends beyond the flanges 116′, and a motor 115′ is mounted on one end of the axle. The motor, which may, for example, be a spring motor, has one portion connected to the axle and another portion connected to flange 116′. When the boom extends to pull the lines 102*a*′ and 104*a*′ off the reel, the portion of the motor 115′ connected to the flange rotates with respect to the portion mounted on the hub. This winds up the spring, which is connected between the two portions of motor 115′, to bias the hub in the direction of arrow C. Consequently, when the boom is retracted, the lines 102*a*′ and 104*a*′ will be wound on the reel. From FIG. 7, it will be noted that when the movable valve spool of valve portion 82′ is shifted to the left of the position shown, fluid under pressure is supplied through line 88′ and passage 70′ to retract chamber 66′. At the same time, fluid in the extend chamber flows through passage 68′ and line 86′ (blocking valve 90′ being opened in response to pressure in line 88′) to the sump. When the spool of valve portion 82′ is shifted to the right, fluid under pressure is supplied to the extend line to flow through check valve 92′ to the extend chamber 64′. At the same time, fluid from the retract chamber 66′ is discharged to the sump. In the first instance, the motor 30 is retracted and in the latter instance the motor 30 is extended.

In a similar manner, when the spool of the second valve portion 84′ is shifted to the left of the position shown, the pressure line PL′ is connected through the valve to retract line 104′ and the return line RL′ is connected to the extend line 102′. When the spool of the second valve portion 84′ is shifted to the right of the position shown, the pressure line PL′ is connected through the valve to extend line 102′ and the return line RL′ is connected through the valve to the retract line 104′. When the pressure line is connected through the retract line to the retract chamber, the motor, and the boom, retracts. Conversely, when the pressure line is connected to the extend line and the extend chamber, the motor, and the boom, is extended.

The presence of the reel 106′ in lines 102′ and 104′ presents a problem in the extension and retraction of the tip boom motor 32′ not present in the extension and retraction of motor 30′. The winding of the flexible hose which forms lines **102*a*′ and 104*a*′ on the reel (which must be of limited size because of space limitations) restricts the flow through the lines 102′ and 104′ to slow the retraction of the tip boom motor 32′**, and the retraction of the tip boom section.

Quick retraction of the telescopic boom is important to the effective and efficient operation of the crane. An examination of FIG. 7 will indicate retraction of the tip boom motor 32′ presents a more critical problem than retraction of the mid boom motor 30′ because of the restriction in lines created by the wound hose on the reel. The fluid in the extend chamber 72′ of a prior art system tip boom cylinder must be discharged through the restriction defined by the hose wound on the reel before the cylinder, and hence the tip boom section, can be retracted. It should be noted that the extend chamber has a substantially larger effective cross-sectional area than the retract chamber, which has a large piston rod (of sufficient diameter to meet strength requirements) extending therethrough. Consequently, the rate of flow of fluid out of extend chamber 72′ on the retraction of the tip boom motor 32′ must be substantially greater than the rate of flow of fluid into the retract chamber 74′. Both the flow out of the extend chamber and the flow into the retract chamber of the prior art tip boom motor are restricted by the hose on the reel, but it is the former flow, which must occur at a greater rate than the latter flow, which is critical. The limitation of space on the reel, and the flexibility required in any hose mounted on the reel, makes it difficult to enlarge the hose of the extend line on the reel to accommodate the greater flow necessary through the extend line.

There is shown in FIG. 6, the circuit of the present invention which permits a substantially greater rate of flow from the extend chamber of the tip boom cylinder, and hence a faster retraction of that cylinder and the tip boom section, without enlarging the reel or sacrificing the flexibility of the hose wound thereon.

It will be noted that the circuit of FIG. 6 shows the mid boom motor 30, the tip boom motor 32, a control valve 80 with a first valve portion 82 and a second valve portion 84. The motors 30, 32, and the control valve 80 with portions 82, 84 thereof, may be identical to the motors 30′, 32′, and the control valve 80′ with portions 82′, 84′ of the circuit of FIG. 7. The circuit of FIG. 6 also contains two holding valves 98, one for each motor, which may be identical to the holding valves 98′ of the circuit of FIG. 7.

In my improved circuit, I have provided a line 132 between the end of rod passage 78 (identical to previously described rod passage 78′ of FIG. 7) and the cylinder 34 for continuous communication between retract chamber 74 of motor 32 and retract chamber 66 of motor 30. Since rod 44 of motor 32 and cylinder 34 are both connected to the mid boom section, and hence move in unison with the mid boom section, the line 132 may be relatively rigid, although I prefer to use a conventional flexible hose for this line. In my circuit I provide an extend line 86 and a retract line 88 (which are both also flexible hosing) connected, respectively, to the piston rod passages 68 and 70 (identical to the previously described rod passages 68′ and 70′) as in the circuit of FIG. 7. I also connect extend line 86 to the first valve portion 82 as was done in the prior art circuit of FIG. 7. However, the retract line 88 I connect to both the first valve portion 82 and the second valve portion 84 (instead of merely the first valve portion as was done in the prior art circuit of FIG. 7) by means of branch lines **88*a* and 88*b*, respectively. It will be noted that with my new circuit, I supply fluid under pressure through pressure line PL, valve 80, line 88 (and rod passage 70 thereof) to retract chamber 66 of mid boom motor 30, and through retract chamber 66 to line 132. Line 132 is in continuous communication, through rod passage 78, to retract chamber 74 of tip boom motor 32. Consequently, operation of either valve portion 82 to 84 to connect line 88*a* or 88*b* to pressure line PL will cause retract chambers 66 and 74 to become pressurized to retract the motors. Conversely, operation of the first or second valve portion 82 or 84 to connect line 88*a* or 88*b* to return line RL will permit discharge of the fluid from retract chamber 74 through rod passage 78 and line 132 to retract chamber 66. Fluid from chamber 66 is discharged through line 88, valve 80** and return line RL.

It will be recalled, as shown in FIG. 5, that the cylinder 34 of mid boom motor 30 is connected to the mid boom section 16, and that the rod end of tip boom motor 32 is also connected to the mid boom section 16. Thus, there is no relative motion at any time between the cylinder 34 and the piston rod 44. Line 132, therefore, does not need to pass over a reel and its size need not be dictated by the physical limitations imposed by the need to utilize a reel which can pay out and wind in a line. Similarly, the lines 86 and 88, which extend between the valve 80 and the rod 42 (which is secured to the base boom section) need not pass over a reel, and the sizes of the lines are not determined by the limitations imposed on a real line.

Figure 8:
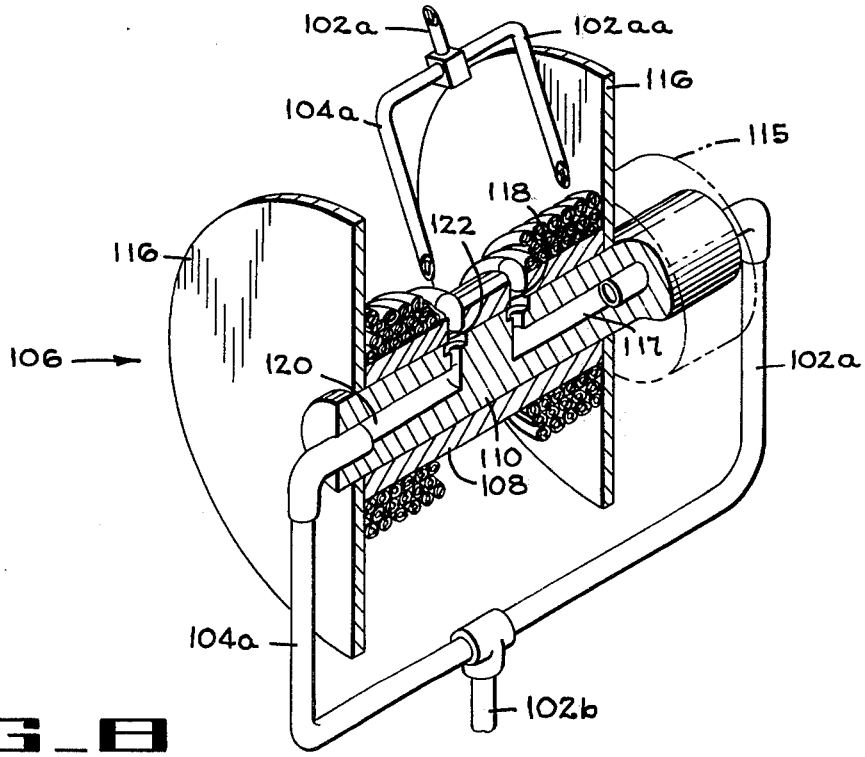
FIG. 8 is a view in perspective of the reel shown in FIGS. 1 and 2, and the hydraulic connections thereto made in accordance with the present invention.

Despite my addition of line 132 to the circuit between the retract chamber 74 of tip boom motor 32 and the cylinder 34 of mid boom motor 30, it is still necessary to pass the extend line 102 from motor 32 to the second valve portion 84 over the reel 106 (see FIG. 8). This line must, therefore, be made of flexible hosing. The reel of FIG. 8 has a hub 108, an axle 110, a motor 115, passages 117 and 120 in the axle, and passages 118 and 122 in the hub, all of which may be identical to the corresponding parts of FIG. 9. However, with the elimination of the retract line from the reel 106, I have been able to provide a double extend line over the reel. It will be noted in FIG. 6, that I denote that part of the line 102 between the motor and the reel as **102*a* and that part of the line 102 between reel and the valve as line 102*b*. I have provided, in the extend line 102 at the reel 106 two parallel branches which are designated 102*aa* and 104*a*, although it will be appreciated that the branch 104*a* of line 102 serves a very different function than the prior art line 104*a*′. The line 102*aa* is wound on the reel, and connected to the hub thereof as the line 102*a*′ of FIG. 9. In the prior art circuit of FIG. 7, the line 104*a*′ passing over the reel was the retract line connecting to the retract chamber of motor 32'. In my improved circuit, I use the line 104***a*, which may be physically identical to the line 104*a'*, and which may be wound on reel 106 in the same manner as the prior art line 104' is wound on reel 106', as a part of my extend line. With this different function, the line 104*a* is connected into the circuit in an entirely different manner than the line 104*a'*. The line 104*a* is connected to the extend line 102 on both sides of the reel, as shown in FIG. 6. Thus, the capacity of the extend line at the reel, which is the critical restriction to flow in the extend line, is doubled to substantially lessen the restriction to flow at the reel. Consequently, the large volume of fluid in the extend chamber 72 of tip boom motor 32 can be more quickly exhausted than previously, and the boom can consequently be more quickly retracted.

Figure 10:
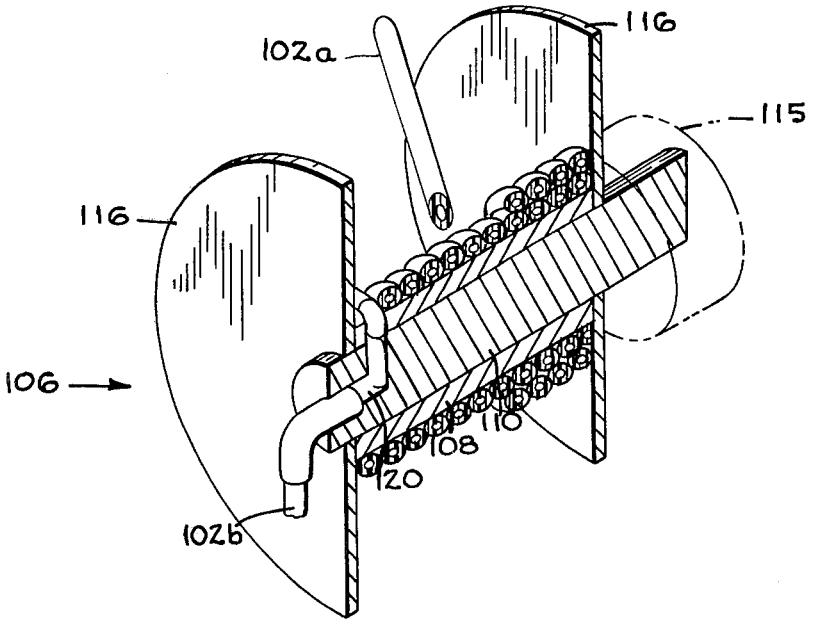
FIG. 10 is a view taken as the view of FIG. 8 showing an alternative form of the hydraulic connections at the reel.

It should be noted that instead of the portions of the two branch lines which are wound on the reel, I can use a single, significantly larger diameter line wound on the reel and connected through a fitting and passage in the hub to axle passage 120 as shown in FIG. 10. Although the use of a single larger line will reduce the restrictive effect caused by the reel, the larger line will not be as flexible as the two smaller lines.

It will thus be seen that by a novel hydraulic circuit modification, I have passed fluid to and from the retract chamber 74 of tip boom motor 32 through the retract chamber and circuit lines of mid boom motor 30. By doing this, I have made available an extra line on the reel to carry the much heavier volume of fluid to and from the extend chamber of tip boom motor 32. Alternatively, I have provided added space on the reel for the use of a larger extend line. Thus, when it is necessary to quickly retract the tip boom section, I can quickly evacuate extend chamber 72 by passing it over the reel in two parallel lines, or in a single larger line.

Although the best mode contemplated for carrying out the present invention has been herein shown and described, it will be apparent that modification and variation may be made without departing from what is regarded to be the subject matter of the invention.

What is claimed is:

1. In a crane having a boom with telescopic sections including a base boom section, a mid boom section, and a tip boom section, a first hydraulic motor connected between the base boom section and the mid boom section for extension and retraction of the mid boom section with respect to the base boom section, and a second hydraulic motor connected between the mid boom section and the tip boom section for extension and retraction of the tip boom section with respect to the mid boom section, each of said motors comprising a cylinder with a piston slidable therein to define an extend chamber and a retract chamber on opposite sides, respectively, of the piston, each piston having a rod connected thereto and extending from the cylinder, said piston rods having two passages in communication with said chambers, respectively, the piston rod of said second motor connected for movement in unison with the cylinder of said first motor, a hydraulic circuit including a source of fluid under pressure and including a valve having a first valve portion between said source and said first motor and having a second valve portion between said source and said second motor, a reel to hold hydraulic lines leading from said second motor rod, the improvement comprising a retract hydraulic line connecting the retract chambers of said motors to pass fluid between said second valve portion and said retract chamber of the second motor through the retract chamber of said first motor, and an extend hydraulic line connecting said extend chamber of said second motor to said valve over the reel.

2. In a crane having a telescopic boom including a base boom section, a mid boom section, and a tip boom section, said crane having an extendable and retractable mid boom motor to extend and retract the mid boom section with respect to the base boom section, said mid boom motor including a cylinder connected to said mid boom section, a piston received in the cylinder, and a piston rod connected at one end to said piston and at the opposite end to said base boom section, said cylinder divided by said piston into extend and retract chambers, extend and retract passages in said mid boom motor extending through said piston rod for communication with said extend and retract chambers, said crane having an extendable and retractable tip boom motor including a cylinder connected to said tip boom section, a piston received in the cylinder, and a piston rod connected at one end to said piston and at the opposite end to said mid boom section, said cylinder divided by said piston into extend and retract chambers, extend and retract passages in said tip boom motor extending through said piston rod for communication with said extend and retract chambers, said crane having a reel to pay out and take in flexible tubing connected to the piston rod of said tip boom motor, and having a valve connected to a source of fluid under pressure, the improvement comprising a fluid retraction circuit branch from said tip boom motor around said reel comprising a fluid line connected to said opposite end of said piston rod in communication with the retract passage therein and to the cylinder of said mid boom motor in communication with the retract chamber therein and a fluid line connected to said opposite end of said mid boom motor piston rod in communication with the retract passage therein and to the valve to define a retract passage from the tip boom motor through the mid boom motor to the valve.

3. In a crane having a boom with telescopic sections, a first hydraulic motor and a second hydraulic motor each connected between adjacent sections of the boom for extension and retraction thereof, each of said motors comprising a cylinder with a piston slidable therein to define an extend chamber and a retract chamber on opposite sides, respectively, of the piston, each piston having a rod connected thereto and extending from the cylinder, said piston rods having two passages in communication with said chambers, respectively, the piston rod of said second motor connected for movement in unison with the cylinder of said first motor, said crane having a reel to take in and pay out line to said second motor, a hydraulic circuit including a source of fluid under pressure and including a valve having a first valve portion between said source and said first motor and having a second valve portion between said source and said second motor, the improvement comprising a retract hydraulic line connecting the retract chambers of said motors to pass fluid betwen said second valve portion and the retract chamber of said second motor through the retract chamber of said first motor, and an extend hydraulic line connecting said extend chamber of said second motor to said second valve portion, only said extend hydraulic line passing over said reel.

4. In a crane having a boom with telescopic sections including a base boom section, a mid boom section, and a tip boom section, a first hydraulic motor connected between the base boom section and the mid boom section for extension and retraction of the mid boom section with respect to the base boom section, and a second hydraulic motor connected between the mid boom section and the tip boom section for extension and retraction of the tip boom section with respect to the mid boom section, each of said motors comprising a cylinder with a piston slidable therein to define an extend chamber and a retract chamber on opposite sides, respectively, of the piston, each piston having a rod connected thereto and extending from the cylinder, said piston rods having two passages in communication with said chambers, respectively, the piston rod of said second motor connected for movement in unison with the cylinder of said first motor, a hydraulic circuit including a source of fluid under pressure and including a valve having a first valve portion between said source and said first motor and having a second valve portion between said source and said second motor, a reel to hold hydraulic lines leading from said second motor rod, the improvement comprising a retract hydraulic line connecting the retract chambers of said motors to pass fluid between said second valve portion and said retract chamber of the second motor through the retract chamber of said first motor, and an extend hydraulic line connecting said extend chamber of said second motor to said valve over the reel, said extend hydraulic line having parallel branches over the reel to reduce the restrictive effect of the reel on the extend hydraulic line.

5. In a crane having a telescopic boom including a base boom section, a mid boom section, and a tip boom section, said crane having an extendable and retractable mid boom motor including a first portion connected to the base boom section and a second portion connected to the mid boom section to extend and retract the mid boom section with respect to the base boom section, said mid boom motor having extend and retract chambers in said second portion and having fluid extend and retract passages therein extending from said extend and retract chambers through said first mid boom motor portion, said crane having an extendable and retractable tip boom motor including a first portion connected to the mid boom section and a second portion connected to the tip boom section to extend and retract the tip boom section with respect to the mid boom section, said tip boom motor having extend and retract chambers in said second portion and having fluid extend and retract passages therein extending from said extend and retract chambers through said first tip boom motor portion, said crane having a reel to receive line from said tip boom motor, the improvement wherein a fluid line is connected to the retract passage in the first portion of said tip boom motor and connected to the retract chamber of said mid boom motor, and wherein only parallel branches of the extend line from the tip boom motor is received on said reel.

6. In a crane having a telescopic boom including a base boom section, a mid boom section, and a tip boom section, said crane having an extendable and retractable mid boom motor including a first portion connected to the base boom section and a second portion connected to the mid boom section to extend and retract the mid boom section with respect to the base boom section, said crane having an extendable and retractable tip boom motor including a first portion connected to the mid boom section and a second portion connected to the tip boom section to extend and retract the tip boom section with respect to the mid boom section, said crane having extend and retract lines connected to the first portion of the mid boom motor and extend and retract lines connected to the first portion of the tip boom motor, said crane having a reel to take in and pay out the tip boom motor line, the improvement comprising a line connecting the retract line of the tip boom motor to the second portion of the mid boom motor for fluid communication between the retract line of the tip boom motor and the retract line of the mid boom motor, and only the extend line of the tip boom motor received on the reel.

7. In a crane having a telescopic boom including a base boom section, a mid boom section, and a tip boom section, said crane having an extendable and retractable mid boom motor to extend and retract the mid boom section with respect to the base boom section, said mid boom motor including a cylinder connected to said mid boom section, a piston received in the cylinder, and a piston rod commected at one end to said piston and at the opposite end to said base boom section, said cylinder divided by said piston into extend and retract chambers, extend and retract passages in said mid boom motor extending through said piston rod for communication with said extend and retract chambers, said crane having an extendable and retractable tip boom motor including a cylinder connected to said tip boom section, a piston received in the cylinder, and a piston rod connected at one end to said piston and at the opposite end to said mid boom section, said cylinder divided by said piston into extend and retract chambers, extend and retract passages in said tip boom motor extending through said piston rod for communication with said extend and retract chambers, said crane having a reel to pay out and take in flexible hosing connected to the piston rod of said tip boom motor, and having a valve to selectively direct fluid under pressure selectively to said extend and retract chambers of said motors, the improvement wherein a fluid retraction circuit branch is provided from said tip boom motor around said reel comprising a first retract fluid line connected to said opposite end of said tip boom motor piston rod in communication with the retract passage therein and to the cylinder of said mid boom motor in communication with the retract chamber therein and a second retract fluid line is connected to said opposite end of said mid boom piston rod in communication with the retract passage therein and connected to the valve to define a retract passage from the tip boom motor through the mid boom motor to the valve, and wherein said flexible hosing on the reel is connected, at one end, only to the extend passage in the piston rod of said tip boom motor and, at the other end, only to the valve.

* * * * *

UNITED STATES PATENT OFFICE

CERTIFICATE OF CORRECTION

Patent No. 4,011,699 Dated March 15, 1977

Inventor(s) Roger D. Mickelson

It is certified that error appears in the above-identified patent and that said Letters Patent are hereby corrected as shown below:

Column 5, line 26: change "plot" to --pilot--.

Column 8, line 22: change first "to" to --or--;

line 44: change "real" to --reel--

Column 12, line 27: change "commected" to --connected--.

Signed and Sealed this

*Twenty-fifth* Day of *September 1979*

[SEAL]

*Attest:*

*Attesting Officer*

LUTRELLE F. PARKER

*Acting Commissioner of Patents and Trademarks*